United States Patent [19]

Robust

[11] 4,025,970

[45] May 31, 1977

[54] SPLASH GUARD FOR BATHTUBS

[76] Inventor: Randy R. Robust, 35 Odeon Court, Carney, Md. 21234

[22] Filed: Oct. 30, 1975

[21] Appl. No.: 627,074

[52] U.S. Cl. ..... 4/173 R

[51] Int. Cl.[2] ..... A47K 3/00; A47J 47/20; E03C 1/181

[58] Field of Search ..... 134/200; 4/1, 145, 146, 4/148, 149, 154, 173, DIG. 5

[56] References Cited

UNITED STATES PATENTS

| | | | |
|---|---|---|---|
| 2,102,082 | 12/1937 | Lucke | 4/173 |
| 2,303,864 | 12/1942 | Reasor | 4/173 X |
| 2,427,375 | 9/1947 | Walker et al. | 4/173 |
| 3,052,248 | 9/1962 | Reuter | 134/200 X |
| 3,639,919 | 2/1972 | White | 4/149 |

*Primary Examiner*—Richard E. Aegerter
*Assistant Examiner*—Stuart S. Levy
*Attorney, Agent, or Firm*—Walter G. Finch

[57] ABSTRACT

The invention provides a splash guard for a bathtub, the present splash guard fitting about the upper periphery of the bathtub walls and having sloping surfaces which flow water incident thereon back into the tub itself.

2 Claims, 4 Drawing Figures

SPLASH GUARD FOR BATHTUBS

BACKGROUND AND SUMMARY OF THE INVENTION

The tub structures used for personal bathing generally are rectangular in shape and have four walls defining, in concert with the floor of the tub, an open water-holding chamber. The walls of these tub structures generally are perpendicular to the floor of the room in which said structures are located, one or more of the walls being located against structural walls of said room. The tub walls typically are surmounted by flat, planar perimetric surfaces which extend about the full upper periphery of the walls, these planar surfaces usually being about four inches in width. Filling of of the bathtub with water and use of the water-filled bathtub usually results in splashing of water from the tub. Such splashed water either impinges against the walls next to the bathtub, splashes into the room, or collects on the aforesaid planar surfaces surmounting the tub walls, any of these possibilities resulting in unsightly, uncleanly, or even unsafe conditions.

The present invention provides a splash guard which is placed about the upper perimetric portion of the bathtub, i.e., on the flat, planar perimetric surfaces which surmount the bathtub walls. The present splash guard is typically formed of a rubber, plastic, or other water-impervious material. The guard can be fitted to the specific size of any bathtub, the guard being preferably formed into four L-shaped sections, the length of either/or both of the arms of the sections being alterable to conform to the dimension of any given bathtub. The present splash guard is also formed with inner wall surfaces which slope downwardly in a concave fashion from the upper perimetric edge portion of the guard, water impinging against this concave surface immediately draining back into the bathtub itself.

It is therefore a primary object of the invention to provide a splash guard for water-containing structure such as bathtubs and the like which prevents at least certain portion of the water splashed from said structures from exiting the structure.

It is another object of the invention to provide a splash guard for bathtubs which prevents water from splashing onto and accumulating on the planar perimetric surfaces surmounting the walls of said bathtubs.

It is a further object of the invention to provide a splash guard for bathtubs and the like and which have sloping concave surfaces which drain water impinging thereonto back into the bathtub itself.

Further objects and advantages of the invention will become more readily apparent in light of the following detailed description of the preferred embodiment of the invention.

DESCRIPTION OF THE PREFERRED EMBODIMENT

Figure 1:
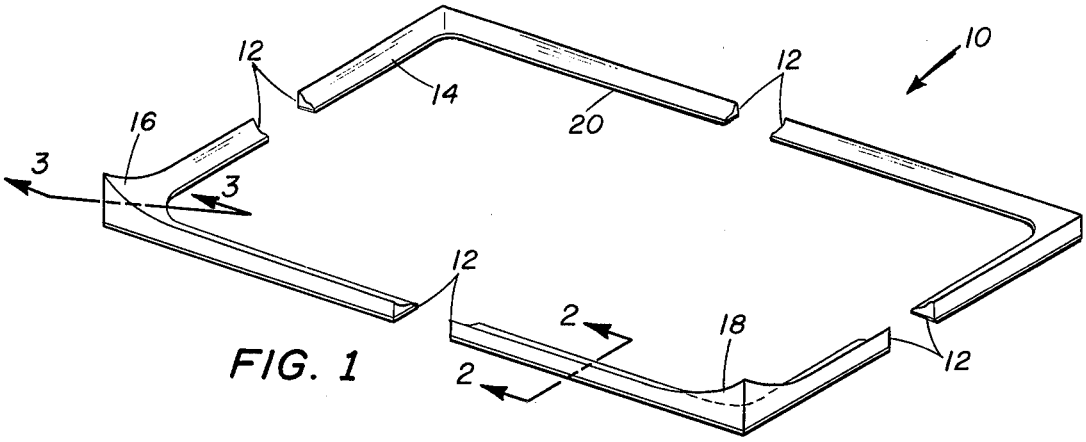
FIG. 1 is a perspective of the present splash guard shown in an assembly-type view, the guard being formed of four separate L-shaped sections.

Referring first to FIG. 1, the present splash guard is seen at 10 to comprise four separate L-shaped sections, two of the sections having corner portions configured to fit against and into a corner formed by intersecting structural walls of a room. The other two L-shaped sections have corner portions which are greater in height than the height of the remaining portions of the sections. The sections of the splash guard 10 fit together at the locations designated 12, the length of the arms of the L-shaped sections being adjustable such as by cutting or trimming to enable the guard 10 to be fitted to bathtubs or water-containing structures of differing dimensions. It is to be understood that the present splash guard 10 could also be formed in one unitary piece to a predetermined rectangular dimension. It should also be understood that the structure of the present splash guard 10 could be adapted to other shapes, such as square, round, oval, or even irregularly shaped bathtubs of any given size. L-shaped sections such as are shown in FIG. 1 are utilized, the section can be joined at the location 12, as seen in FIG. 4, by means of any suitable adhesive.

Figure 2:
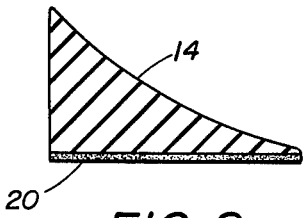
FIG. 2 is a section taken along line 2—2 of FIG. 1.
Figure 3:
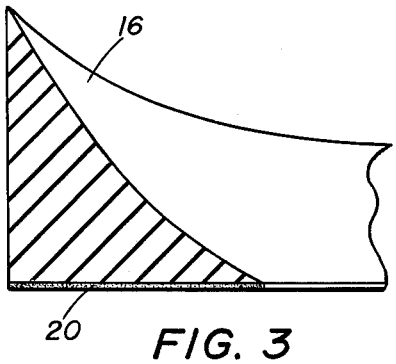
FIG. 3 is a section taken along line 3—3 of FIG. 1.
Figure 4:
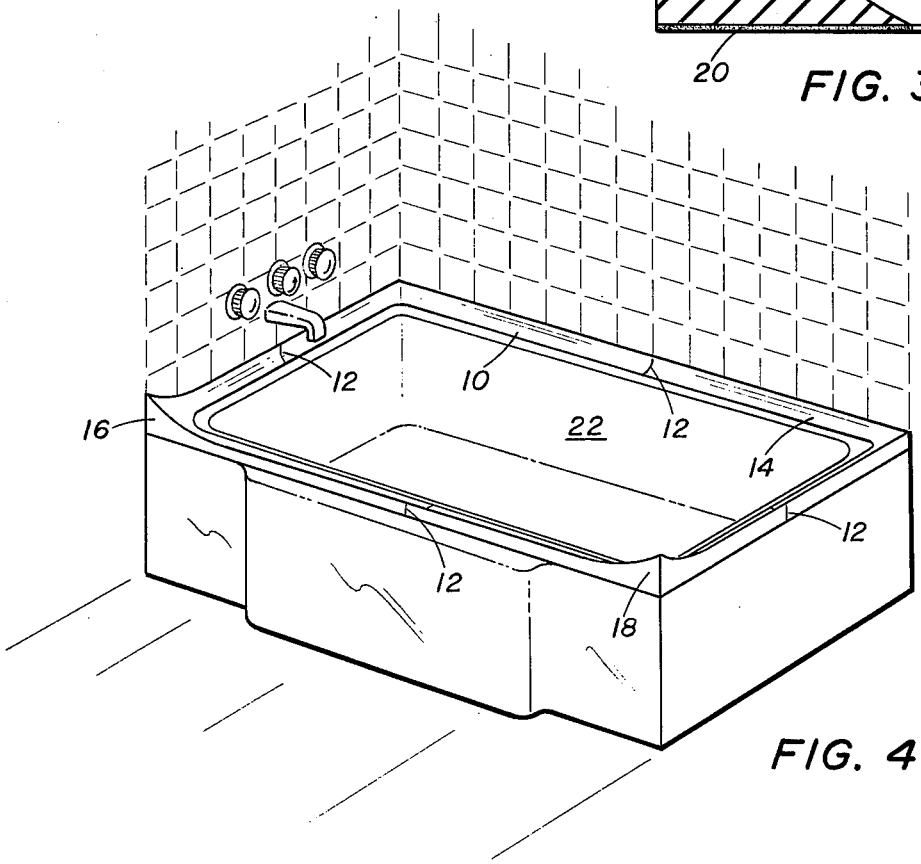
FIG. 4 is a perspective view of the present splash guard shown installed onto a bathtub.

As can be most easily seen in FIG. 4, the splash guard 10 is installed about the outer perimeter of the flat, planar perimetric surfaces which surmount the walls of a bathtub 22. The outer wall surfaces of the guard 10 are preferably perpendicular to these planar surfaces and fit flushly with the vertical surfaces of the bathtub walls. The guard 10 is provided with an adhesive layer 20 on its lower surfaces, as best seen in FIGS. 2 and 3, which contact the planar surfaces of the bathtub walls. This adhesive layer 20 maintains the guard 10 in position on the bathtub 22.

As is seen in all of the figures and particularly in FIGS. 2 and 3, the inner wall surfaces of the guard 10 slope inwardly in a concave fashion, designated at 14, over the full perimeter of the guard 10. These inner wall surfaces 14 slope concavely from the upper edge portion of the guard 10 to the inner edge portion thereof. Thus, water splashing from the interior of the bathtub 22 and which would normally pass just over the bathtub walls or which would impinge on the flat perimetric surfaces surmounting the bathtub walls, impinges instead against the concave inner wall surfaces 14 of the guard 10. Due to the concave nature of the surface 14, the water drains back into the bathtub 22 rather than exiting the bathtub or collecting on the surfaces surmounting the walls of the bathtub.

The outer corners of the guard 10 can also be formed at 16 and 18 into raised corner members, which members 16 and 18 are greater in height at the intersection of the sides of the guard 10 than at other points along the guard 10. The corner members 16 and 18 both slope downwardly in a concave fashion in both directions from the apex of the dihedral angle formed by each of the members 16 and 18. The greater height of the corner members 16 and 18 primarily acts to add structural stability to the guard 10.

It is to be understood that the invention can be configured other than as explicitly described hereinabove, the scope of the invention being limited only by the appended claims.

What is claimed is:

1. A splash guard for water-containing structures such as bathtubs and the like, comprising:

a guard having a plurality of L-shaped guard members, each of said guard members having arms intersecting at 90° angles, said guard members fitting together at the ends of said arms to form a continuous horizontal wall-like barrier around the periphery of the water-containing structure, each said guard member having inwardly sloping inner wall surfaces, said guard members having their longitudinal axis horizontally disposed about the upper periphery of the water containing structure, said guard having at least one corner portion on the guard member, the said corner portion being greater in height at its highest point than adjacent points along the upper edge portion of the guard members, said inwardly sloping inner wall surfaces of the guard member being concavely formed, and the outer wall surfaces of said guard member fitting flushly with vertical side wall of the water-containing structure.

2. The splash guard of claim 1 and further comprising an adhesive layer formed on a lower surface of the splash guard for adhering to surfaces on the upper periphery of the water-containing structure.

* * * * *